United States Patent [19]

Wagener

[11] Patent Number: 5,064,145

[45] Date of Patent: Nov. 12, 1991

[54] MODEL AIRPLANE WITH TAIL ASSEMBLY

[75] Inventor: Claus Wagener, Dietenhofen, Fed. Rep. of Germany

[73] Assignee: Fritz Wagener GmbH

[21] Appl. No.: 585,663

[22] Filed: Sep. 20, 1990

[30] Foreign Application Priority Data

Oct. 19, 1989 [DE] Fed. Rep. of Germany ..... 3934840

[51] Int. Cl.[5] ..... B64C 9/02; A63H 27/18

[52] U.S. Cl. ..... 244/87; 244/131; 446/34

[58] Field of Search ..... 244/87, 91, 131, 190; 446/230, 34, 35, 36

[56] References Cited

U.S. PATENT DOCUMENTS 3,735,524 5/1973 Staats et al. ..... 446/34
3,935,664 2/1976 Neuhierl ..... 446/34
4,233,773 11/1980 Jones ..... 446/34

FOREIGN PATENT DOCUMENTS 8714733 4/1989 Fed. Rep. of Germany .

*Primary Examiner*—Joseph F. Peters, Jr.
*Assistant Examiner*—Carla Mattix
*Attorney, Agent, or Firm*—Toren, McGeady & Associates

[57] ABSTRACT

A model airplane is provided wherein the fuselage formed with a tail is horizontally divided and provided at said aft end portion with a vertical stabilizing surface and two horizontal stabilizing surfaces. It is desirable that the aft end portion of the fuselage should be held together and a root or roots of the stabilizing surfaces be located with a smooth and streamlined surface being maintained on the underside of the aft end of the fuselage by insertion from the aft end of the fuselage. This is achieved in that a duct which is open at the aft end of the fuselage extends through the fuselage portions and portions of at least one root of a stablizing surface, and in that a pin is fittingly inserted in the duct. This method of connecting eliminates the need for screws, detents and a well in the underside of the aft end region of the fuselage.

5 Claims, 2 Drawing Sheets

MODEL AIRPLANE WITH TAIL ASSEMBLY

BACKGROUND OF THE INVENTION

The invention relates to a model airplane with a tail fin assembly wherein a fuselage formed with a tail is divided horizontally into an upper half and a lower half, and wherein a vertical stabilizing surface and two horizontal stabilizing surfaces are provided on the aft end portion of the fuselage, and wherein a root on the vertical stabilizing surface extends through a hole in the top of said upper half into the fuselage and a root each on the horizontal stabilizing surfaces extends through a hole in the sides of the fuselage into the fuselage, and wherein devices are provided on the fuselage for connecting the upper and lower halves of the fuselage with each other and for locating the vertical stabilizing surface and the horizontal stabilizing surfaces on the fuselage.

In a prior art (German Utility Patent 87 14 733) model airplane of this type there is provided in the underside of the fuselage a well into which is inserted a screw which is screwed into the upper part of the fuselage. The root of the vertical stabilizing surface is provided with detents which cooperate with abutments in the fuselage as the screw is tightened. The well is closed to the outside by a plug member which constitutes a discontinuity in the otherwise smooth and streamlined surface of the underside of the aft end of the fuselage.

SUMMARY OF THE INVENTION

It is an object of the present invention to create a model airplane of the type initially referred to, wherein the integrity of the tail end of the fuselage and locating of the horizontal and vertical stabilizing surfaces are achieved by inserting means from the aft end of the fuselage with a smooth and streamlined surface of the underside of the tail end being maintained. The model airplane according to the invention which solves this problem is characterized in that a duct is provided which is open at the aft end of the fuselage and extends through portions of the fuselage and portions of at least one root of the stabilizing surfaces and in that a pin means is fittingly inserted in said duct.

The devices for connecting and locating the stabilizing surfaces in the model airplane according to the invention eliminate the need for a screw, detents and a well in the underside of the aft end of the fuselage and consequently are simplified. In so far as these devices are concerned, a smooth and streamlined surface is obtained on the underside of the tail of the airplane. Assembly is simplified. The pin means not only holds together the upper and lower halves of the fuselage but also locates at least one stabilizing surface on the fuselage. Since the pin means is a close fit in the duct which is appropriately positioned, insertion of the pin means causes the upper and lower halves of the fuselage to be joined to each other and the stabilizing surfaces to the fuselage with a press-fit, i.e. they are pressed onto each other. Apart from a pointed front end, the pin means may, for instance, be of constant outside diameter or cross-sectional area over its length. As a rule, the pin means would have a pointed end and can therefore also be described as a needle.

It is conceivable to have the pin means or needle slid through the roots of the horizontal stabilizing surfaces, for instance, through holes in vertical lugs on these roots in order to locate the horizontal stabilizing surfaces in this fashion. The pin means and the bore need not extend in parallel with the longitudinal centreline of the fuselage, but may also be inclined downwards to the front. As a rule, the pin means would be straight, but it may also be curved. The bore may, for instance, be continuous or formed by bore sections spaced apart.

It is specially desirable and advantageous to have a stopper placed on the tail end in the aft end of the bore. The stopper will seal the bore and the pin means to the outside and, as a rule, will be formed as an imitation of an exhaust gas nozzle. This improves the authenticity of the model airplane at its aft end.

In a further embodiment, it is advantageous and desirable to have the inserted pin means project with an end piece from the aft end of the fuselage. In order to dismantle the fuselage, pliers would be applied to the projecting end piece to pull out the pin means.

It is also specially desirable and advantageous to have a free space with same length as the pin means provided in the fuselage in continuation of the inserted pin means. The inserted pin means would, as a rule, be arranged fully inside the fuselage and, to dismantle the fuselage, a mandrel would be used to push the pin means through the duct into said free space.

Furthermore, it would be specially desirable and advantageous, if the root of the stabilizing surface through which the duct extends were the root of the vertical stabilizing surface, and if the two horizontal stabilizing surfaces were provided with separate flat roots arranged to interlock with each other in the fuselage to withstand any pull across the longitudinal centreline of the fuselage, and maintained in a common plane by the fuselage halves. By drawing the fuselage halves together, the pin means would also ensure positive fixing of the horizontal stabilizing surfaces without it being necessary to penetrate through lugs on the horizontal stabilizing surfaces. Moreover, it would be specially desirable and advantageous, if the pin means were inserted through upwardly projecting lugs of the lower half of the fuselage and downwardly projecting roots of the vertical stabilizing surface which is supported on the outside of the upper half of the fuselage. This configuration would ensure the integrity of all parts of the tail of the model airplane in a simplified fashion by the inserted pin means.

BRIEF DESCRIPTION OF THE DRAWINGS

A preferred embodiment of the invention is shown in the accompanying drawing in which.

DETAILED DESCRIPTION OF THE PREFERRED EMBODIMENTS

Figure 1:
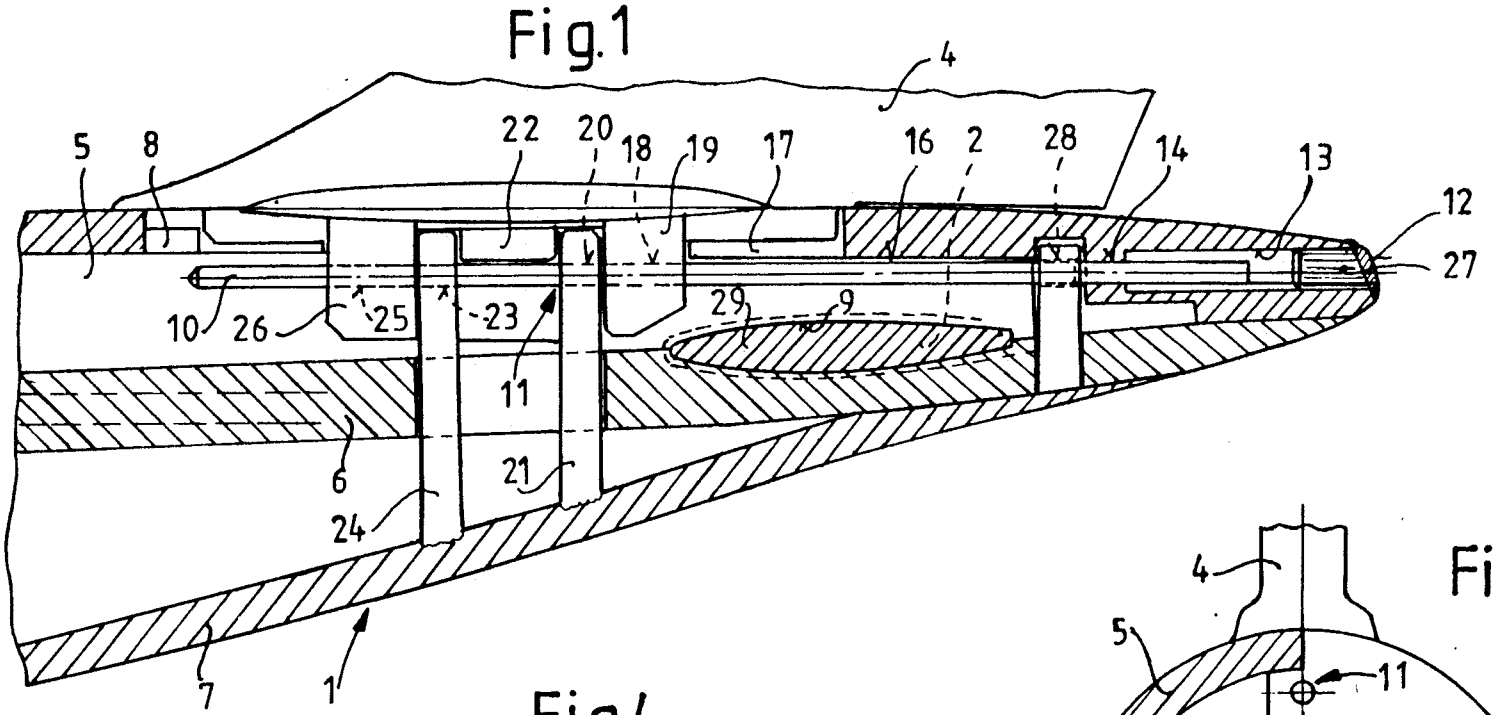
FIG. 1 is a vertical section through the aft end of the fuselage of a model airplane with stabilizing surfaces.

The model airplane according to the drawing has an aft fuselage portion 1 to which are fitted two mirror-image horizontal stabilizing surfaces 2,3 and a vertical stabilizing surface 4. The aft end of the fuselage 1 is divided the same as the complete fuselage horizontally into an upper half 5, a middle deck 6 and a lower half 7. The horizontal stabilizing surfaces 2, 3 are located on the upper half 5 and the middle deck 6 and the vertical stabilizing surface 4 are located on the upper half 5. Provided in the upper half 5 of the fuselage, there is a cutout 8 for the vertical stabilizing surface and in the sides of the upper half 5 of the fuselage there is a slot 9 each which also extends into the middle deck 6 for a horizontal stabilizing surface 2, 3.

Devices are provided for connecting and locating the components comprising a needle-type elongate pin means 10 which is inserted into a duct 11. The duct 11 starts at the aft end 12 of the fuselage with an oversize bore section 13 to continue with a bore fitting the pin means in a thicker part of the upper half 5 of the fuselage. From there, the duct 11 continues through a hole 28 in a lug 15 of the lower half 7 of the fuselage. Following the hole 14, there is a groove section 16 in which the pin means 10 is located at the top by a thickening of the upper half 5 of the fuselage and a ledge 17 of the vertical stabilizing surface 4. Following this, there is a hole 18 in a lug 19 of the vertical stabilizing surface 4 and a hole 20 in a lug 21 of the lower half 7 of the fuselage. Following a ledge 22 of the vertical stabilizing surface 4 providing upwards constraint, there is a hole 23 in a lug 24 of the lower half 7 of the fuselage and a hole 25 in a roots 26 of the vertical stabilizing surface 4.

At the aft end, the duct 11 is closed at the bore 13 by means of a stopper 27. The lower half 7 of the fuselage is located on the pin means 10 by means of three lugs 15, 21, 24 which extend column-fashion from the bottom of the lower half of the fuselage to the top through cutouts in the middle deck 6. The vertical, stabilizing surface 4 is located on the pin means 10 by means of two roots 19, 26 which extend from the vertical stabilizing surface downwards through a cutout 8 in the upper half 5 of the fuselage which provides support for the vertical stabilizing surface around the cutout 8. This clamping action causes all parts at the aft end of the model airplane to be held together. The horizontal stabilizing surfaces 2, 3 each have a root 29 which extends through the slot 9 and is clamped between the upper half 5 of the fuselage and the middle deck 6. These roots 29 interlock puzzle-fashion with flat lobes 30 and matching recesses.

Figure 2:
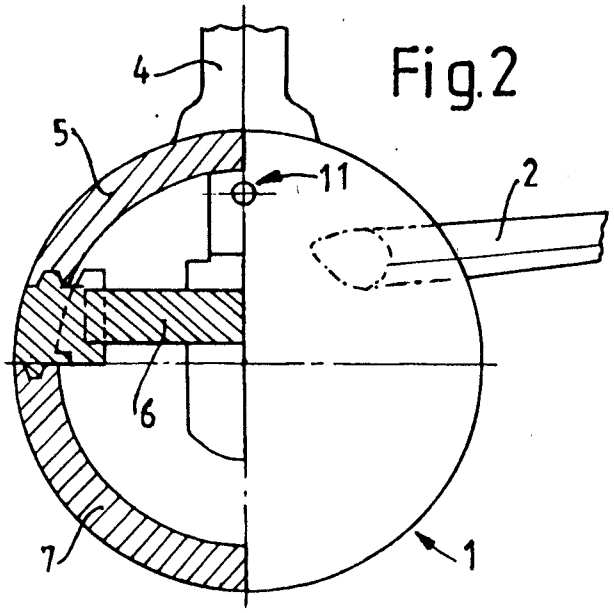
FIG. 2 is a rear view of the model airplane in FIG. 1 with a sectioned portion in the left-hand half of the figure.
Figure 4:
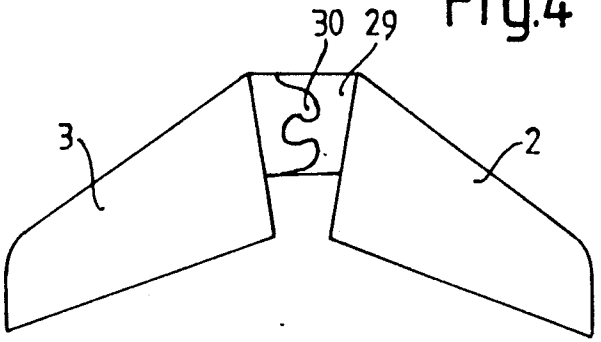
FIG. 4 is a plan view on a reduced scale compared to FIG. 1 of the horizontal stabilizing surfaces of the model airplane in FIG. 1.
Figure 3:
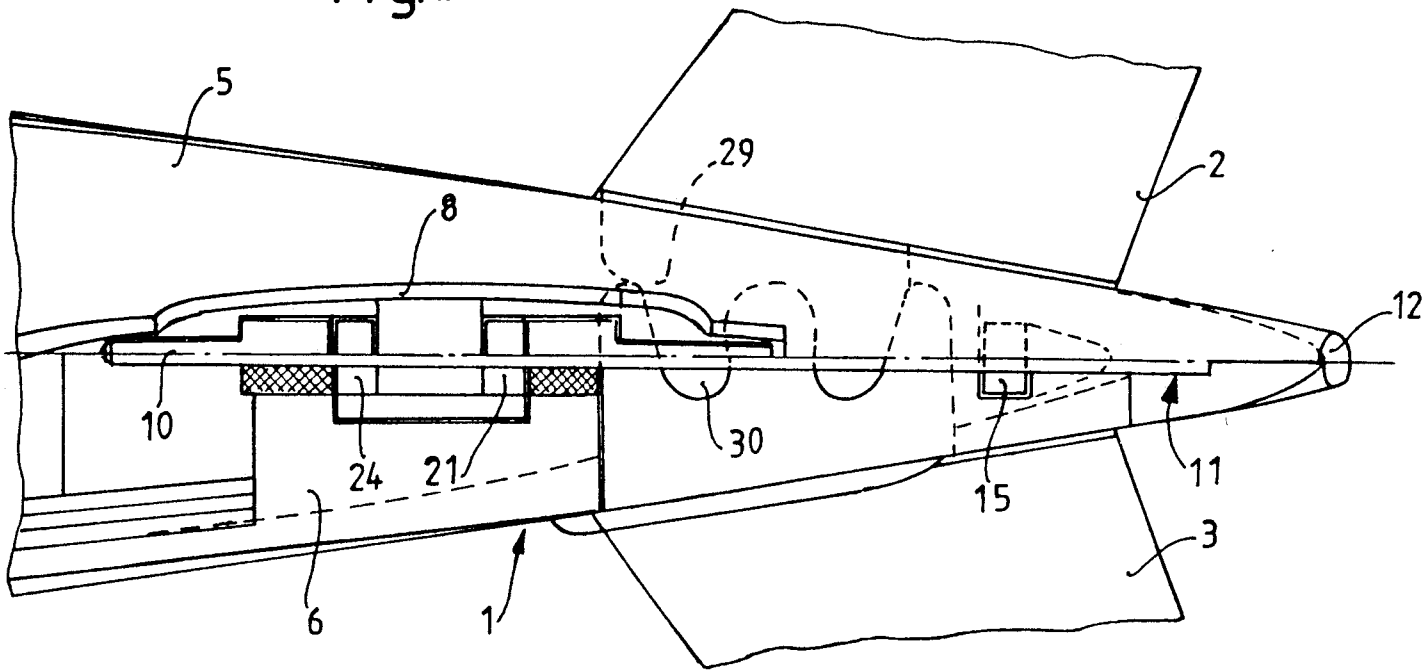
FIG. 3 is a plan view with a sectioned portion of the model airplane in FIG. 1.

In FIG. 3 the vertical stabilizing surface has been omitted and in FIG. 2 one horizontal stabilizing surface has been omitted. FIG. 2 illustrates the method of supporting the vertical stabilizing surface 4 on the upper half 5 of the fuselage. FIG. 4 illustrates the interlocking of the two roots 29 between the horizontal stabilizing surfaces 2, 3, the two roots forming a connecting link.

I claim:

1. A model airplane with a tail fin assembly, comprising: a fuselage formed with a tail end and horizontally subdivided into an upper fuselage portion and a lower fuselage portion;

a vertical stabilizing surface and two horizontal stabilizing surfaces attached to the tail end of the fuselage, the vertical stabilizing surface having a root which extends into the fuselage through a recess in the upper fuselage portion, and each of the horizontal stabilizing surfaces has a root which extends into the fuselage through a recess in a side of the fuselage;

devices provided for connecting the upper and lower fuselage portions with each other and for fixing the vertical stabilizing surface and the horizontal stabilizing surfaces on the fuselage;

a duct open towards the tail end of the fuselage and extending through areas of the upper and lower fuselage portions and at least one of the stabilizing surface roots; and pin means fittingly inserted into said duct so that the upper fuselage portion, the lower fuselage portion, the vertical stabilizing surface, and the horizontal stabilizing surfaces are pressed against each other with a press fit.

2. A model airplane as in claim 1, wherein a stopper is placed on an aft end of the duct at the tail end of the fuselage.

3. A model airplane as in claim 1, wherein the fuselage is provided with a free space, having a length equal to that of the pin means, as a continuation of the inserted pin means.

4. A model airplane as in claim 1, wherein the root of the stabilizing surface through which the duct extends is the root of the vertical stabilizing surface, the two horizontal stabilizing surfaces being provided with separate flat roots which are interlocked with each other in the fuselage so as to withstand tension across the longitudinal centreline of the fuselage and are maintained in a common plane by the fuselage portions.

5. A model airplane as in claim 1, wherein the pin means is inserted through upwardly extending lugs of the lower portion of the fuselage and downwardly extending roots of the vertical stabilizing surface which is seated on the outside of the upper portion of the fuselage.

* * * * *